US005203398A

United States Patent [19]

Easwaran

[11] Patent Number: 5,203,398

[45] Date of Patent: Apr. 20, 1993

[54] LOW TEMPERATURE PROCESS FOR EVAPORATIVE PATTERN CASTING

[75] Inventor: Jay Easwaran, Portage, Mich.

[73] Assignee: The Board of Trustees of Western Michigan University, Kalamazoo, Mich.

[21] Appl. No.: 830,177

[22] Filed: Jan. 31, 1992

[51] Int. Cl.[5] ..... B22C 9/04

[52] U.S. Cl. ..... 164/516; 164/34

[58] Field of Search ..... 164/516, 517, 518, 519, 164/361, 34, 35

[56] References Cited

U.S. PATENT DOCUMENTS

| | | | |
|---|---|---|---|
| 3,572,417 | 3/1971 | Wismer | 164/43 |
| 4,115,504 | 9/1978 | Dewitte et al. | 264/221 |
| 4,640,728 | 2/1987 | Martin et al. | 156/245 |
| 4,995,443 | 2/1991 | Easwaran | 164/34 |

*Primary Examiner*—Kuang Y. Lin

*Attorney, Agent, or Firm*—Flynn, Thiel, Boutell & Tanis

[57] ABSTRACT

A method is disclosed for the casting of metals by the use of a consumable or vaporizable pattern. In this method, a foamed pattern of a desired part is first formed. The pattern is then dipped into a ceramic slurry and the slurry dried in order to form a shell containing the foamed pattern. A bed of a particulate medium heated to a temperature of from 700° to 1000° F. is formed around the ceramic shell to cause the pattern to vaporize without burning and form a mold. A molten metal is then introduced into the mold, solidified and removed from the mold to form a casting. An inert atmosphere can be provided over the bed of heated particulate medium during the vaporization of the pattern to help suppress the burning of the vaporized pattern.

13 Claims, No Drawings

LOW TEMPERATURE PROCESS FOR EVAPORATIVE PATTERN CASTING

BACKGROUND OF THE INVENTION (1) Technical Field

This invention relates to the formation of metal parts by the use of foam patterns which are consumed or evaporated during the casting of the metal.

(2) Description of the Prior Art

The casting or molding of metals is an art that has been in existence for a very long time and yet, surprisingly, has not experienced very many changes with respect to the basic techniques or materials used in the process.

A typical prior art process for making a casting is by the "lost foam" or "evaporative pattern casting" method. This method initially requires the formation of a foam pattern out of a consumable polymeric material.

This foam pattern is then dipped or coated with a ceramic slurry and placed in a bed of dry, loose, cool sand. The sand bed is thoroughly vibrated to compact the particles around the coated pattern. After the compaction is completed, molten metal is poured directly onto the polymeric pattern. The pattern gradually evaporates as it comes in contact with the molten metal. The products of evaporation, mostly gases, are vented into the dry sand bed, leaving behind a cavity for the molten metal to fill. As the evaporation, followed by filling by molten metal is completed, an exact replica of the polymeric pattern is reproduced in metal.

This typical prior art process of "lost foam" casting has problems in that the formation of the ceramic shell is costly and time consuming. The porosity of the ceramic shell also has to be carefully controlled in order to allow the gases evolved during the evaporation of the polymeric pattern exit through the shell. Another problem with this conventional process is that the polymeric pattern often decomposes into lustrous carbon and gases which become defect core impurities in the metal part. In order to address this problem, the density of the pattern has to be carefully regulated, which also involves the expenditure of additional time and expense.

There also exists the possibility that the ceramic shell may warp or crack because of the introduction of the molten metal therein. This would necessitate the formation of a new ceramic shell which would entail additional expenditures of time and expense.

In another "lost foam" or "evaporative casting" process, an oven is used to burn out the polymeric foam pattern from the ceramic shell. This process also requires the polymeric foam pattern to be coated with a large number of coats of the ceramic material since the ceramic shell ultimately must support the molten metal, and the problems also arise of damaging the ceramic shell during its removal from the oven and the ceramic shell warping during the burning out of the foam pattern.

Another prior art process for making a casting is the "lost wax" or "investment casting process". The "lost wax" process entails the coating of a wax pattern with a ceramic slurry. The coated wax pattern is inserted into a steam autoclave to remove the pattern. The removal of the wax pattern weakens the ceramic shell so the ceramic shell must be heated at temperatures up to 2000° F. in order to strengthen it. Molten metal is then introduced into the ceramic shell in order to form a casting.

Due to the weakness of the ceramic shell, the subsequent handling of the shell in order to introduce the molten metal therein, and the need for the ceramic shell to have sufficient strength to contain the molten metal without external support, from 10–14 coats of the ceramic slurry is applied to the wax pattern. The application of the large number of ceramic coatings consume a great deal of time and money.

U.S. Pat. No. 3,572,417 discloses a method for casting or molding metals in a mold. The mold comprises a refractory inorganic oxide foam which has been formed by heating a filled organic foam at a temperature and time sufficient to substantially decompose an organic binder to a carbonaceous state, or, alternatively, to substantially consume the organic binder to form a refractory inorganic foam. This patent discloses the use of an oven to decompose the organic binder and to fuse or sinter the remaining inorganic components. However, the formation of the "green" mold is an extremely complicated process and the time and expense involved in heating the "green" mold to a temperature sufficient to decompose the organic binder and fuse the remaining inorganic components is unnecessarily high.

U.S. Pat. No. 4,115,504 discloses a method for casting vitreous materials using the lost wax process. In this patent, a pattern of the article to be cast is made using a substance which is vaporized during the casting. Wax, polystyrene and polyethylene are disclosed as being suitable materials for the pattern. The pattern can be coated with a thin layer of a mixture of graphite and a refractory powder and then embedded in a heat resistant silica compound to form a casting mold. The silica compound typically is moistened or contains a cohesive material, such as a resin, in order to insure that the portion of the sand mold adjacent to the surface of the cast articles dries thoroughly. A vitreous material having a viscosity of between 20 and 100 poises is introduced into the mold and decomposes the pattern. The article formed in the mold can be ceramified by fluidizing the sand by means of a hot stream of gas. It is to be noted that this reference deals with the formation of a vitreous article, not a metal article, and requires that the viscosity of the casting material be maintained in a certain range in order for the casting material not to pierce the mold.

U.S. Pat. No. 4,640,728 discloses a method of joining foam patterns which are used in evaporative casting processes. This patent discloses a method of assembling complex, consumable foam patterns for use in evaporative pattern metal casting but gives no particulars as to the evaporative pattern process per se.

U.S. Pat. No. 4,995,443 discloses a method for producing a cast metal object in which a heated particulate medium at a temperature of between 1500°–2000° F. is used to support a ceramic shell containing a consumable polymeric pattern. The heat from the heated particulate medium causes the polymeric pattern to decompose and vaporize and form a cavity in the ceramic shell into which molten metal may be introduced. The molten metal is then allowed to solidify and form the cast metal object. Due to the high temperature of the particulate medium in this method, problems arise with respect to the handling and disposal of the vapors from the decomposed pattern.

It is an object of the present invention to provide a method for forming a cast metal article by the evaporative casting process which does not contain the drawbacks of the processes used in the prior art.

More specifically, it is an object of the present invention to provide an evaporative casting process which does not require the formation of a ceramic shell comprised of a large number of individual layers of the ceramic material.

It is an additional object of the present invention to provide an evaporative casting process in which the porosity of the ceramic shell is not a factor and which reduces the possibility of the ceramic shell warping or cracking during subsequent uses.

It is a further object of the present invention to provide an evaporative casting process which forms a cast metal article not having gas or lustrous carbon defects present in the casting.

It is a still further object of the present invention to provide an evaporative casting process which reduces the expenses typically associated with such a process by minimizing or eliminating the pollution problems caused by the vaporization of a decomposable pattern used in the casting process and reducing the energy requirement needed in removing the pattern.

It is a still further object of the present invention to improve the surface finish and dimensional attributes of the cast parts made by the evaporative casting process.

SUMMARY OF THE INVENTION

These and other objects of the present invention are accomplished by providing an evaporative casting process which uses a particulate medium at a temperature of from 700° to 1000° F. as a means for supporting the ceramic shell and decomposing the polymeric pattern contained in the ceramic shell and, optionally, an inert gas to fluidize the particulate medium or to form an inert gas blanket over the particulate medium to suppress the burning of the decomposed polymeric pattern. The particulate medium can be coated with a catalytically active material to aid in the control of fumes generated during the decomposition of the polymeric pattern.

The particulate medium serves as a means for support for the ceramic shell during the casting process and thereby enables the ceramic shell to be much thinner, i.e., comprise fewer ceramic layers, than is possible in the prior art processes. The particulate medium also provides support for the ceramic shell during the evaporation of the foam pattern. This reduces the possibility of the shell warping or cracking during the evaporation stage and the heat from the particulate medium hardens the shell. The low temperature of the particulate medium enables the burning of the decomposed polymeric pattern to be reduced or eliminated, thereby reducing pollution problems and yet also accomplishes the complete decomposition of the polymeric pattern to also eliminate gaseous and lustrous carbon defects in the cast part because the polymeric pattern is completely removed from the casting shell before the metal is introduced therein.

In a further embodiment of the present invention, the heated particulate medium surrounding the ceramic shell is replaced by a cooler particulate medium while still maintaining constant support of the ceramic shell thereby allowing the casting of nonferrous metals by the process. The cast metal articles can be annealed while in the ceramic shell and, if the shell is removed from the heated sand and cracked open, the articles can be quenched in ambient air.

DETAILED DESCRIPTION

The low-temperature evaporative casting process of the present invention requires an expendable or consumable foam replica or pattern of the part to be cast. Suitable materials of construction for the pattern are materials which will decompose at the temperature of the heated sand used in the present process. Preferred materials are polymeric compounds such as polystyrene, polymethyl methacrylate and polyalkyl carbonate with polystyrene and polymethyl methacrylate being especially preferred.

A consumable foam pattern may be prepared in a typical manner such as by introducing polystyrene or polymethyl methacrylate beads into an aluminum die and injecting steam into the die to fuse the polymeric material and form a pattern. With the present invention, the density of the consumable pattern is not critical. However, in order to avoid combustion problems during the vaporization of the pattern, when polystyrene is used as the material of construction for the consumable pattern, a preferred density of the pattern is about 1 $lb/ft^2$.

After the pattern is formed, it is assembled with the necessary gating, pouring cups and sprues that will be necessary to introduce the molten metal into the evacuated ceramic shell.

This pattern assembly is then disposed on a hook and dipped in a tank of ceramic slurry comprising a fused silica refractory, a colloidal silica binder and water. The average particle size of the fused silica is not critical and may range from about 50 mesh to about 400 mesh. A preferred average particle size is between about 100 mesh and 300 mesh with an average particle size of about 200 mesh being especially preferred. The amount of colloidal silica binder present in the slurry is dependent on the particle size and amount of fused silica present. A desirable amount of colloidal silica is between 5–10 percent by weight based on the weight of the fused silica in the slurry. The ceramic slurry is preferably maintained at about 60 percent solids but the temperature of the slurry is not critical and can be maintained at ambient temperatures. Although a specific type of ceramic slurry is described above, in the present invention, the term "ceramic" is intended to cover any suitable inorganic material.

After the pattern assembly is completely wetted by the ceramic slurry, it is removed from the slurry bath and placed in a fluidized bed of fused silica powder. The fused silica powder has a particle size of about −50 to +100 mesh and air or any other suitable fluidizing gas is used as the fluidizing medium. The pattern assembly is disposed in the fluidized bed of fused silica powder until it is completely coated with the powder. The ceramic slurry coating and the fused silica coating together constitute an initial ceramic shell layer. After the initial ceramic shell layer is formed on the pattern assembly, the assembly is removed from the fluidized bed of fused silica powder and the initial shell layer dried in air. The coating steps are repeated between 1–5 times to produce a strong enough final ceramic shell for the subsequent casting operations. The porosity of the final ceramic shell is not critical but desirably, the thickness of the final ceramic shell is approximately 6–25 mm. thick.

After the final ceramic shell is air dried, a bed of a dry particulate medium, which is heated to a temperature between 700° to 1000° F. and contained in a suitable container for the process conditions is formed around the entire assembly. The material of construction of the container can be any glass, ceramic or metal that can withstand the process conditions and a preferred particulate medium is sand. The particulate medium preferably have a spherical or angular shape and a size distribution between −40 mesh to +200 mesh. The sand particles can be silica, alumina, zirconia or olivine and combinations thereof with olivine being preferred.

The particulate medium may additionally be coated with a catalytic material which aids in the pollution control of the gases of the vaporized pattern by suppressing the formation of elemental carbon. The amount of catalyst used with respect to the weight of the particulate medium is dependent on the amount and type of material used to make the pattern and the type of catalyst used. When platinum is used, a desirable weight percent is 0.01 percent with respect to the weight of the particulate medium. The platinum is deposited on the particulate medium by dipping it into a platinum containing solution, such as platinum chloride, and then drying the coated particulate medium.

The bed of heated particulate medium can be formed around the ceramic shell containing the polymeric mold by pouring the heated particulate medium around the ceramic shell, introducing the ceramic shell into a fluidized bed of a heated particulate medium and compacting the fluidized bed around the ceramic shell, or inserting the ceramic shell into a quiescent bed of the heated particulate medium. A preferred method of forming the bed of heated particulate medium around the ceramic shell is to insert the ceramic shell into a fluidized bed of a heated particulate medium and compact the fluidized bed around the ceramic shell. The fluidizing medium for the bed of heated particulate medium is preferably an inert gas, such as argon or nitrogen, which not only serves to fluidize the bed but also suppresses the burning of the vaporized polymeric pattern by displacing the air around and in the heated particulate bed.

When the pattern assembly is completely covered by the heated particulate medium, the level of the particulate medium should be just sufficient to be flush with the top of the pouring cup.

The pattern assembly is rapidly heated by the hot particulate medium and the consumable pattern vaporized therefrom. As another aid in avoiding pollution problems, the consumable pattern can be vaporized in an inert atmosphere such as a nitrogen/argon or steam atmosphere. As discussed above, these gases can also be used as the fluidizing medium for the particulate medium.

If the decomposition of the pattern was carried out in an ambient atmosphere and at a high temperature, dark smoke would be produced from the combustion of the consumable pattern. This smoke would be comprised of various hydrocarbons and gaseous carbon. This smoke would be captured and incinerated to maintain healthy working conditions. The use of a particulate medium heated to a temperature of only 700° to 1000° F. and, optionally, coated with a catalytically active material, aids in the control of the combustion of the liberated gases by reducing the amount of gaseous carbon generated.

The use of a particulate medium bed heated to a temperature of only 700° to 1000° F. to vaporize the polymeric pattern not only helps the suppression of the burning of the vaporized polymeric pattern, it also results in a substantial savings in energy costs over the prior art methods which require the particulate medium bed to be heated and maintained at a temperature of at least 1500° F. during the removal of the pattern.

Once the entire consumable pattern is evaporated by the heated particulate medium from the ceramic shell to form a mold, molten metal is introduced into the mold by way of the pouring cup. The particulate medium provides support for the mold during the pouring of the molten metal, allows the mold to be supported without movement, and reduces the possibility of the ceramic shell cracking or warping during the introduction of the molten metal.

If a nonferrous metal is used as the casting material, a cool fresh particulate medium is used to replace the heated particulate medium in the container holding the heated particulate medium after the molten metal has been poured into the mold. The temperature of the cool particulate medium is preferably from about room temperature to about 125° F. The heated particulate medium can be withdrawn from the bottom of the container and the cool fresh particulate medium introduced through the top of the container.

After the cast metal has cooled and solidified, it can be removed from the mold to form the cast metal part.

The following examples will serve to illustrate the present invention.

EXAMPLE 1

An expanded polystyrene foam pattern of an automobile brake calliper was prepared in a modified injection molding machine using an aluminum die containing a steam chest. The pattern produced from this machine had a density of 1.6 lbs. per cubic foot. The pattern was "cured" at room temperature for one week prior to use in the process to make a casting.

The "cured" pattern was attached to sprues and gates made of the same polystyrene foam. Hot melt adhesive was used to securely fasten the gates and sprues to the pattern.

After the gating system had been securely attached, the entire assembly was immersed in a slurry containing fused silica with an average particle size of 200 mesh. This fused silica was dispersed in water with colloidal silica as a binder. After the pattern assembly was completely coated with this slurry, the assembly was removed and coated with dry fused silica with particle sizes of −50 mesh to +100 mesh in a fluidized bed. When the dry particles had adhered to the wet slurry-coated assembly, the pattern assembly was dried in ambient air for about one hour.

After this initial coating had dried, a back-up slurry coating was applied. Fused silica flour with an average particle size of 120 mesh was mixed with water and colloidal silica to form a slurry. The coated and dried pattern assembly was dipped in this slurry until it was completely wetted by the slurry. The pattern was removed from the slurry and coated with dry fused silica flour with a particle size range of −30 mesh to +50 mesh in a fluidized bed. When this dry coating had adhered to the wet slurry, the entire pattern was taken out of the fluidized bed and allowed to dry in air.

This back-up coating procedure was then administered again so that the coating around the pattern had built up to a thickness of 0.25 inches.

The fully coated and dried pattern assembly was lowered into an air-fluidized bed containing aluminum oxide particles (between 60–100 mesh) heated to a temperature between 750°–900° F. After the pattern assembly was fully lowered into the fluidized bed, the air supply was shut off and pattern assembly was gently vibrated. The aluminum oxide particles completely surrounded the pattern assembly and raised its temperature to a point where the pattern began to vaporize by the heat. The vapors were evacuated from the surface of the fluidized bed and cleanly incinerated outside the fluidized bed. Within one minute the entire polystyrene pattern had evaporated.

After the polystyrene had completely evaporated and was externally incinerated, an empty hard shell was left in the fluidized bed. This shell was ready to receive molten metal to form a casting. Molten metal was poured into the shell cavity as is and after the heated shell was removed from the fluidized bed prior to pouring.

Castings were made from grey iron, ductile iron, carbon and stainless steel. During the pouring it was observed that no smoke or fumes were evolved, indicating that the polystyrene foam had been completely evaporated from the cavity. Dimensional measurements on the castings showed that they were true reproductions of the pattern. Castings made by this procedure were also free of lustrous carbon defects that are normally present in conventional lost foam castings.

EXAMPLE 2

In this example, the procedure of Example 1 was followed except that nitrogen was used as the fluidizing medium, instead of air. As a result, the polystyrene foam evaporated from the fluidized bed without ignition of the vapor occurring and lustrous carbon defects produced in the casting.

Excellent castings of ductile irons and steel were obtained without the presence of lustrous carbon defects.

EXAMPLE 3

In this example, the procedure of Example 1 was followed with air being used as the fluidizing medium, however, the surface of the fluidized bed was blanketed by nitrogen to eliminate the possibility of ignition of the polystyrene vapor. The dilution of the air by the nitrogen minimized the oxygen contained in the region immediately above the fluidized bed and prevented the ignition of the foam vapor.

Once again good quality ductile iron and stainless steel castings free of lustrous carbon defects were obtained.

EXAMPLE 4

In this example, the procedure of Example 1 was followed except that water was sprayed just above the surface of the fluidized bed as the polystyrene foam was evaporated. The water evaporated and produced a steam blanket which diluted the air and reduced the oxygen available to ignite the foam. The latent heat of vaporization of the water also cooled the air above the evaporating styrene foam which also minimized the possibility of ignition.

Again, good quality ductile iron and stainless steel castings free of lustrous carbon defects were obtained.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method of producing a cast metal part comprising the steps of forming a pattern of the metal part out of a heat-vaporizable material; forming a ceramic shell around said pattern; forming a bed of a particulate medium heated to a temperature of from 700° to 1000° F. around said ceramic shell; vaporizing the pattern to form a mold; introducing molten metal into said mold; solidifying said molten metal; and removing said solidified molten metal from said mold to form a cast metal part.

2. The method of claim 1, wherein the molten metal is introduced into the mold without removing the mold from the heated particulate medium bed.

3. The method of claim 1, wherein the vaporized pattern is incinerated at a location remote to the heated particulate medium.

4. The method of claim 1, wherein the bed of heated particulate medium is formed around the ceramic shell by inserting the ceramic shell into a bed of a heated fluidized particulate medium and compacting said heated fluidized particulate medium around said ceramic shell.

5. The method of claim 4, wherein the bed of heated particulate medium is fluidized by an inert gas.

6. The method of claim 1, wherein said pattern is vaporized in an inert atmosphere.

7. The method of claim 1, wherein said heat-vaporizable material is a polymer.

8. The method of claim 7, wherein said polymer is selected from the group consisting of polystyrene and polymethyl methacrylate.

9. The method of claim 6, wherein said inert atmosphere is formed by providing a nitrogen gas blanket over said bed of heated particulate medium during the vaporization of said pattern.

10. The method of claim 6, wherein said inert atmosphere is formed by providing a steam blanket over said bed of heated particulate medium during the vaporization of said pattern.

11. The method of claim 1, wherein said particulate medium is sand.

12. The method of claim 1, wherein said particulate medium has a platinum-containing coating provided thereon.

13. A method of producing a cast metal part comprising the steps of forming a pattern of the metal part out of a heat-vaporizable material; a ceramic shell around said pattern; forming a bed of a particulate medium heated to a temperature of from 700° to 1000° F. around said ceramic shell; vaporizing the pattern to form a mold; introducing a molten metal into said mold; replacing said heated particulate medium around said mold containing said molten metal with a particulate medium at a lower temperature than said heated particulate medium; solidifying said molten metal; and removing said solidified molten metal from said mold to form a cast metal part.

* * * * *

UNITED STATES PATENT AND TRADEMARK OFFICE

CERTIFICATE OF CORRECTION

PATENT NO. : 5 203 398

DATED : April 20, 1993

INVENTOR(S) : Jay EASWARAN

It is certified that error appears in the above-identified patent and that said Letters Patent is hereby corrected as shown below:

Column 8, line 54, after "material;" insert ---forming---.

Signed and Sealed this

First Day of March, 199

*Attest:*

*Attesting Officer*

BRUCE LEHMAN

*Commissioner of Patents and Trademarks*